US006010157A

United States Patent [19]

Pierson et al.

[11] Patent Number: 6,010,157

[45] Date of Patent: Jan. 4, 2000

[54] TWO-PIECE COVER FOR BINDING A PLURALITY OF SHEETS

[75] Inventors: Thomas S. Pierson, Sparta, N.J.; James D. Funkhouser, Redkey, Ind.

[73] Assignee: Pengad, Inc., Bayonne, N.J.

[21] Appl. No.: 09/138,584

[22] Filed: Aug. 21, 1998

[51] Int. Cl.[7] ..... B42D 3/00; B42D 1/10

[52] U.S. Cl. ..... 281/21.1; 281/15.1; 281/29; 281/36; 281/38; 412/1; 412/4; 412/6; 412/7; 412/43

[58] Field of Search ..... 281/21.1, 15.1, 281/36, 29, 38; 412/1, 4, 6, 7, 43

[56] References Cited

U.S. PATENT DOCUMENTS

| | | | |
|---|---|---|---|
| 5,601,312 | 2/1997 | Funkhouser | 281/29 |
| 5,683,111 | 11/1997 | Bass et al. | 281/21.1 |
| 5,893,585 | 4/1999 | Worthen | 281/45 |

*Primary Examiner*—Willmon Fridie, Jr.
*Assistant Examiner*—Mark T. Henderson
*Attorney, Agent, or Firm*—Arnold D. Litt

[57] ABSTRACT

A two-piece cover for binding a stack of loose sheets into a booklet or brochure is disclosed. The cover includes a front cover panel and a rear cover panel. The rear cover panel includes a cover portion and a spine portion. The spine portion includes a front side and a back side, and is adapted to be folded to securely bind the stack of loose sheets within the cover. The spine portion includes a plurality of score lines respectively defining fold sections. The cover further includes a first second and third adhesive strips respectively coupled to the back side of the first fold section, the back side of the fourth fold section, and the front side of the fifth fold section. In use, the spine portion is folded along the third score line to create a recess between the second fold section and the third fold section into which the loose sheets of paper may be placed and secured. The spine portion is then folded such that the adhesive strips on the first and fourth fold section are brought into engagement with the back side of the second and third fold sections. The rear cover panel is then secured to the front cover panel to thereby complete the formation of the cover for binding a stack of loose sheets of paper.

20 Claims, 3 Drawing Sheets

TWO-PIECE COVER FOR BINDING A PLURALITY OF SHEETS

BACKGROUND OF THE INVENTION

1. Field of the Invention

The invention relates to a cover for binding a plurality of sheets into a booklet or brochure. More particularly, the invention relates to a two-piece cover for manually binding a plurality of sheets into a booklet or brochure while maintaining a clean, aesthetically pleasing outward appearance.

2. Description of the Prior Art

Many booklet and brochure covers are known in the prior art. However, the various covers have limitations and shortcomings not addressed in the prior art. For example, while some covers provide a two piece construction allowing the user to imprint materials on the front cover before the assembly of the entire cover, these covers often fail to provide the stability and aesthetically pleasing appearance found in other one piece covers.

Unfortunately, however, while the one piece covers often offer stability and an aesthetically pleasing design, they are very difficult to work with when it is necessary to imprint material on the front cover. The large size of the one piece covers make it difficult, if not impossible to imprint materials on the front cover using conventional copiers and other imprinting techniques.

As such, a need continues to exist for a cover which provides stability, convenience and an aesthetically pleasing appearance. The present invention provides such a cover.

SUMMARY OF THE INVENTION

It is, therefore, an object of the present invention to provide a two-piece cover for binding a stack of loose sheets into a booklet or brochure. The cover includes a front cover panel and a rear cover panel, wherein the front cover panel is shaped and dimensioned to cover a top of the stack of loose sheets and is adapted to have printed or graphic material applied to at least one side thereof by way of a printing means. The rear cover panel includes a cover portion and a spine portion. The cover portion is a flat sheet shaped and dimensioned to cover a bottom of the stack of loose sheets. The spine portion also includes a front side and a back side, and is adapted to be folded to securely bind the stack of loose sheets within the cover. The spine portion includes first, second, third, fourth and fifth score lines respectively defining first, second, third, fourth and fifth fold sections of the spine portion. The first score line lies adjacent the cover portion and separates the cover portion from the spine portion. The cover further includes a first adhesive strip coupled to the back side of the spine portion along the first fold section, a second adhesive strip coupled to the back side of the spine portion along the fourth fold section, and a third adhesive strip coupled to the front side of the spine portion along the fifth fold section.

In use, the spine portion is folded along the third score line to create a recess between the second fold section and the third fold section into which the stack of loose sheets may be placed and secured. The spine portion is then folded along the second score line such that the first adhesive strip on the first fold section is brought into engagement with the back side of the second fold section and the spine portion is folded along the fourth score line such that the adhesive strip on the fourth fold section is brought into engagement with the back side of the third fold section. The rear cover panel is adapted to be secured to the front cover panel by bringing the adhesive strip on the fifth fold section into contact with a front side edge of the front cover panel to thereby complete the formation of the cover for binding a stack of loose sheets.

It is also an object of the present invention to provide a cover wherein the first, second and third adhesive strips respectively include an adhesive strip covered by a release strip.

It is another object of the present invention to provide a cover wherein the rear cover panel is rectangular shaped.

It is a further object of the present invention to provide a cover wherein the front cover panel is substantially the shape of the rear cover portion of the rear cover panel.

It is also an object of the present invention to provide a cover wherein the second fold section and third fold section are larger than the first fold section and the fourth fold section.

It is another object of the present invention to provide a cover wherein the fifth fold section is the largest of the fold sections.

It is a further object of the present invention to provide a cover wherein the fifth fold section is the largest of the fold sections.

It is also an object of the present invention to provide a method for assembling the present cover.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
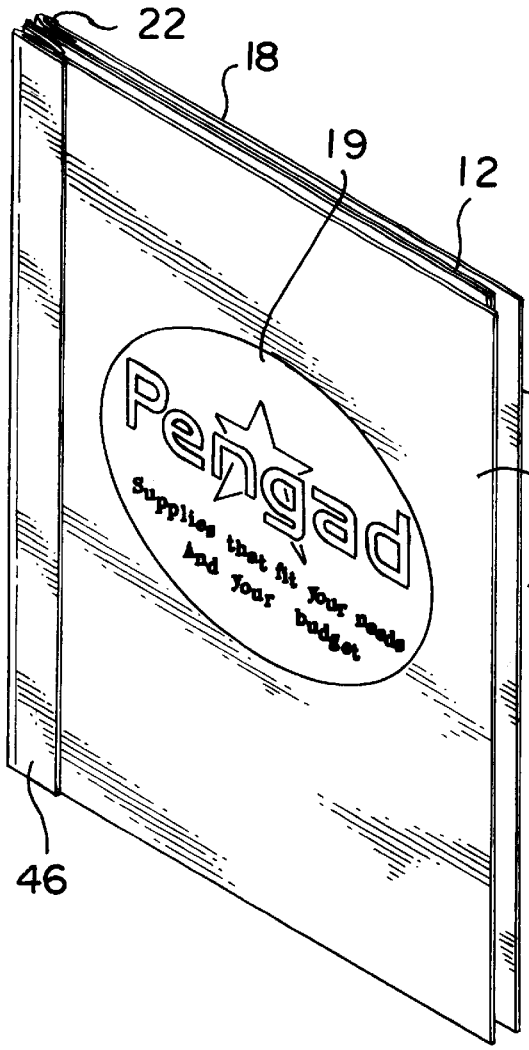
FIG. 1 is a perspective view of the present two-piece cover.
Figure 2:
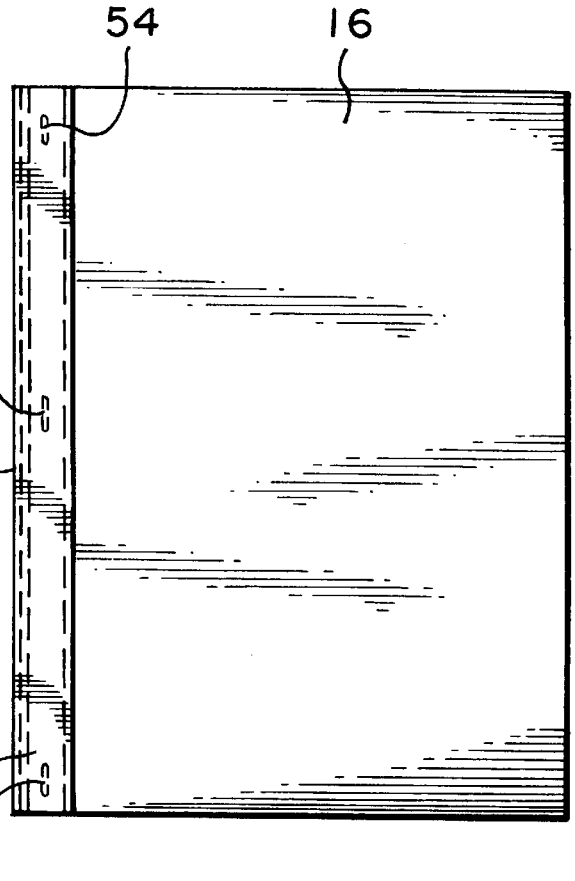
FIG. 2 is a front plan view of the present two-piece cover.
Figure 3:
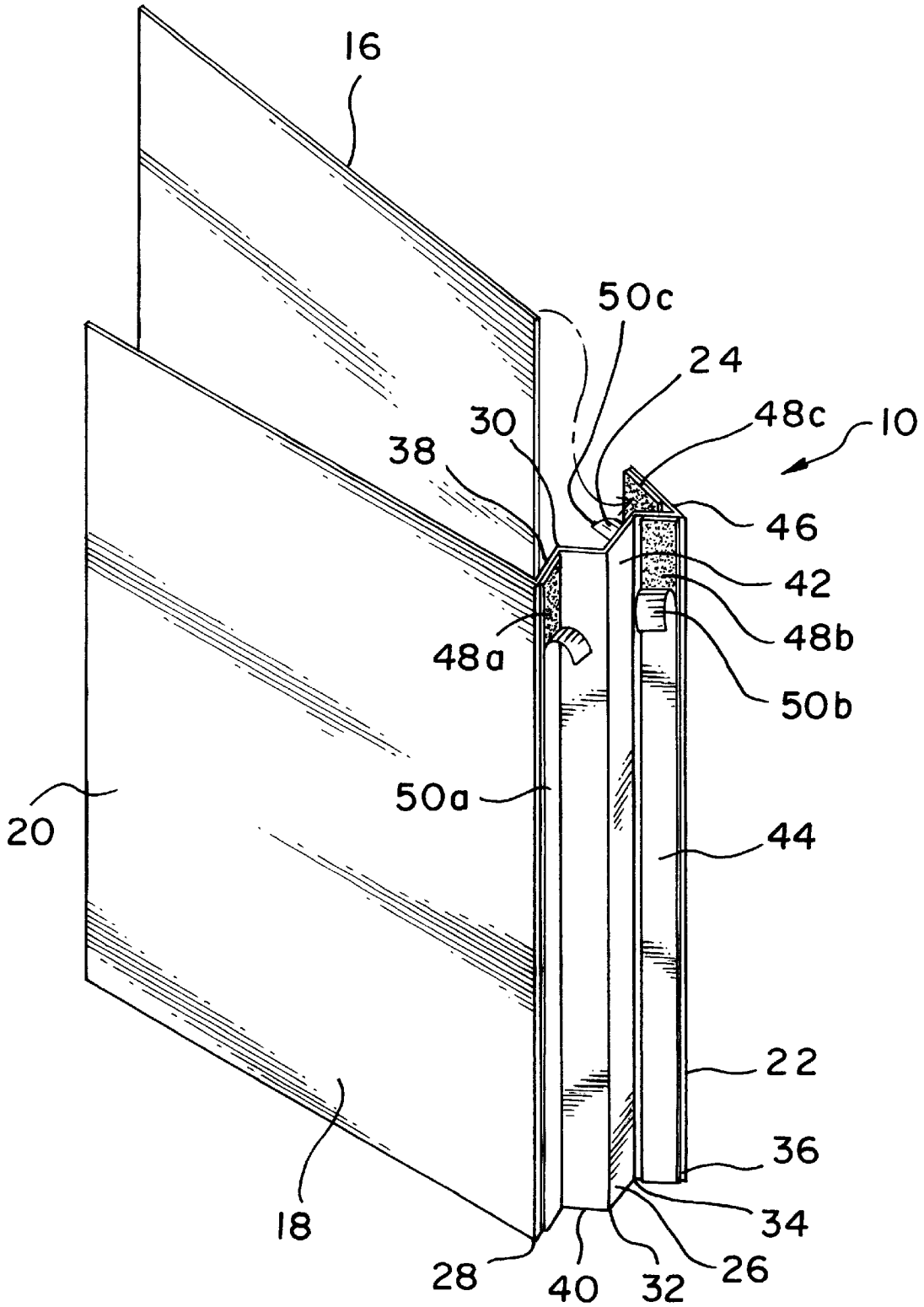
FIG. 3 is an exploded perspective view of the present two-piece cover.
Figure 4:
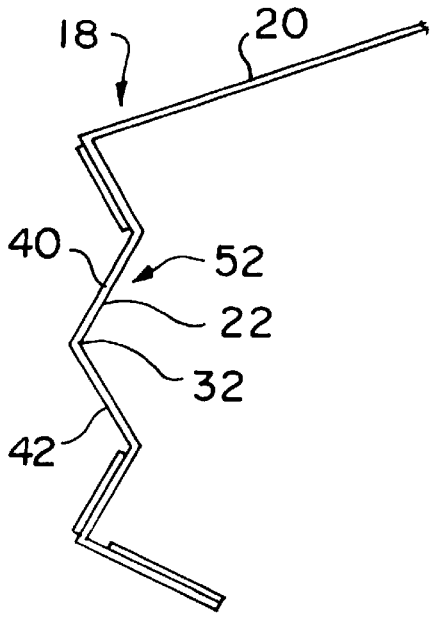
FIGS. 4–7 are cross sectional views showing the process for assembling the present two-piece cover.
Figure 5:
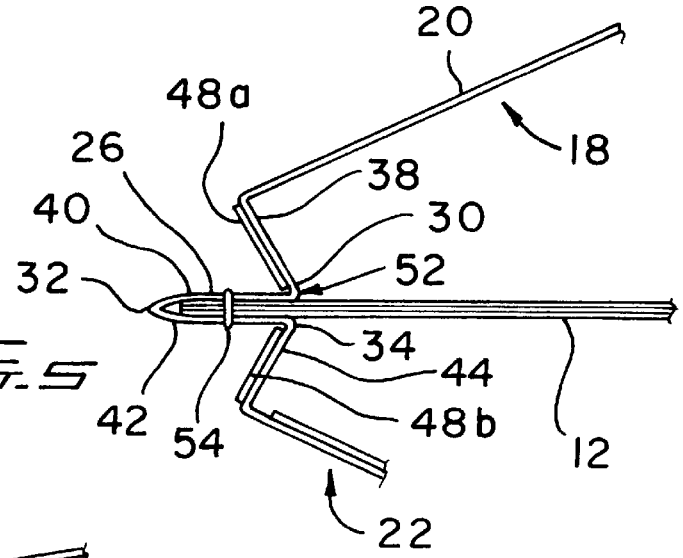
Figure 6:
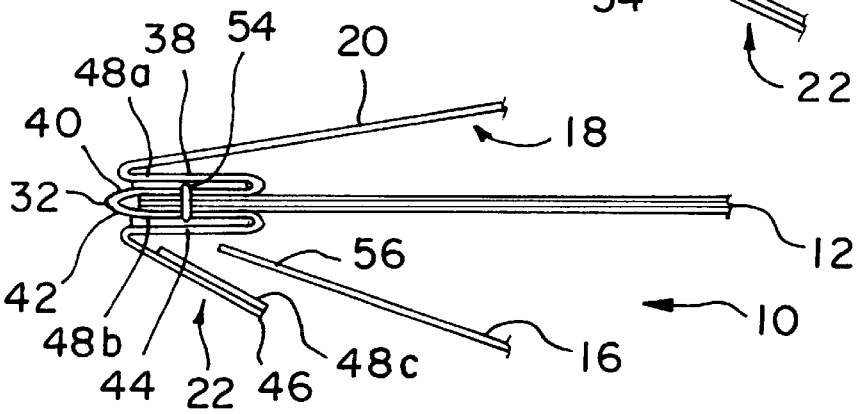
Figure 7:
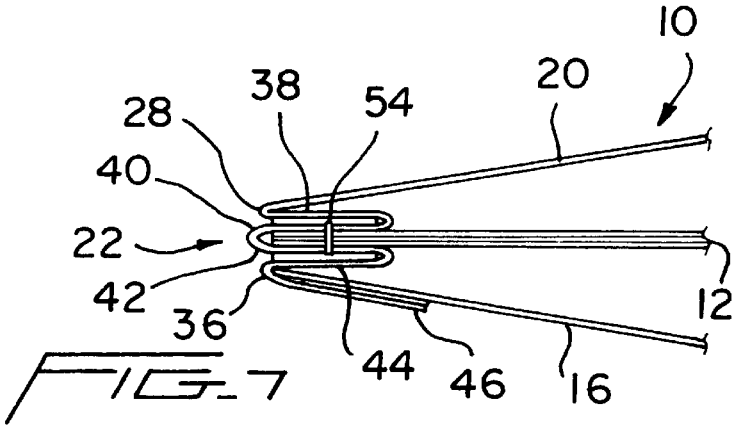

With reference to FIGS. 1 through 7, a two-piece cover 10 for binding a stack of loose sheets 12 into a booklet or brochure is disclosed. The two-piece cover 10 includes a front cover panel 16 and a rear cover panel 18. Each cover panel contains longitudinal side edges. In addition, the front cover panel 16 is adapted to have printed or graphic material 19 applied to at least one side thereof by way of a printing means. For example, the front cover panel 16 is made of a material which permits the printing of graphic material therein by convention means, such as, photocopiers and/or computer printers. As such, the front cover panel 16 may be made from common paper, photographic paper, or transparent sheets. The front cover panel 16 may also be made from other materials without departing from the spirit of the present invention.

The front cover panel 16 is commonly made in a conventional shape, that is, rectangular, which is adapted to cover the stack of loose sheets 12 bound within the cover. However, the front cover panel 16 may take a variety of shapes without departing from the spirit of the present invention.

The rear cover panel 18 is generally rectangular shaped. However, and as discussed above with regard to the front cover panel 16, the rear cover panel 18 may take on a variety of shapes without departing from the spirit of the present invention. The rear cover panel 18 includes a rear cover portion 20 and a spine portion 22. The rear cover portion 20 is a flat sheet shaped and dimensioned to cover the bottom of the stack of loose sheets 12. As such, the rear cover panel 18 is generally rectangular and matches the shape of the front cover panel 16. The rear cover panel 16 may be provided with built in pocket designed to accommodate additional loose sheets.

The spine portion 22 of the rear cover panel 18 includes a front side 24 and a back side 26. The spine portion 22 is adapted to be folded to securely bind the stack of loose sheets 12 within the cover 10. The spine portion 22 accordingly includes a first score line 28, second score line 30, third score line 32, fourth score line 34 and fifth score line 36. The score lines define adjacent first fold section 38, second fold section 40, third fold section 42, fourth fold section 44 and fifth fold section 46. The first score line 28 lies adjacent the rear cover portion 20 and separates the rear cover portion 20 from the spine portion 22.

In addition, adhesive strips 48*a*, 48*b* covered by release strips 50*a*, 50*b* are respectively coupled to the back side 26 of the spine portion 22 along the first fold section 38 and the fourth fold section 44. The adhesive strips 48*a*, 48*b* extend substantially the length of the first and fourth fold sections 38, 44 for reasons that will be discussed in greater detail below. In addition, an adhesive strip 48*c* covered by a release strip 50*c* is positioned on the front side 24 of the spine portion 22 along the fifth fold section 46.

In use, and with reference to FIGS. 4 through 7, the second fold section 40 and the third fold section 42 are folded along the third score line 32 to create a recess 52 into which the stack of loose sheets 12 may be placed and secured. The stack of loose sheets 12 is preferably secured within the recess by stapling 54 the stack of loose sheets 12 between the second and third fold sections 40, 42. While stapling is disclosed as the preferred method for binding the stack of loose sheets 12, other methods may be employed without departing from the spirit of the present invention.

Stapling the stack of loose sheets 12 between the second fold section 40 and the third fold section 42 leaves exposed staples along the second and third fold sections 40, 42. However, the first and fourth fold sections 38, 44 cover the second and third fold sections 40, 42 in the following manner. The release strip 50*a* on the first fold section 38 is removed and the spine portion 22 is folded along the second score line 30 such that the adhesive strip 48*a* on the first fold section 38 is brought into engagement with the back side 26 of the second fold section 40. Similarly, the release strip 50*b* on the fourth fold section 44 is removed and the spine portion 22 is folded along the fourth score line 34 such that the adhesive strip 48*b* on the fourth fold section 44 is brought into engagement with the back side 26 of the third fold section 42, thereby covering the staples when the stack of loose sheets 12 are stapled between the second and third fold sections 40, 42.

Once the first and fourth fold sections 38, 44 are respectively secured to the second and third fold sections 40, 42, the front cover panel 16 may be secured to the rear cover panel 18. Specifically, the release strip 50*c* on the fifth fold section 46 is removed and the adhesive strip 48*c* is brought into contact with a front side edge 56 of the front cover panel 16 to thereby complete the assembly of a cover 10 for binding the stack of loose sheets 12.

The cover 10 is completed by folding the spine portion 22 along the first score line 28 and the fifth score line 36 to bring the front cover panel 16 and the rear cover portion 20 in position over the stack of loose sheets 12. In this way a stable, convenient and an aesthetically pleasing cover 10 is created.

While the preferred embodiment has been shown and described, it will be understood that there is no intent to limit the invention by such disclosure, but rather, is intended to cover all modifications and alternate constructions falling within the spirit and scope of the invention as defined in the appended claims.

We claim:

1. A two-piece cover for binding a stack of loose sheets into a booklet or brochure, comprising:

a front cover panel and rear cover panel, wherein the front cover panel is shaped and dimensioned to cover a top of the stack of loose sheets and is adapted to have printed or graphic material applied to at least one side thereof by way of printing means, wherein the front cover panel is independent of the stack of loose sheets;

the rear cover panel includes a cover portion and a spine portion, the cover portion is a flat sheet shaped and dimensioned to cover a bottom of the stack of loose sheets, and the spine portion includes a front side and a back side and is adapted to be folded to securely bind the stack of loose sheets within the cover;

the spine portion includes first, second, third, fourth and fifth score lines respectively defining first, second, third, fourth and fifth fold sections of the spine portion, the first score lines lies adjacent the cover portion and separates the cover portion from the spine portion;

first adhesive means are coupled to the back side of the spine portion along the first fold section, second adhesive means are coupled to the back side of the spine portion along the fourth fold section, and third adhesive means are coupled to the front side of the spine portion along the fifth fold section;

wherein the spine portion is folded along the third score line to create a recess between the second fold section and the third fold section into which the stack of loose sheets may be placed and secured; and the spine portion is then folded along the second score line such that the first adhesive means on the first fold section is brought into engagement with the back side of the second fold section and the spine portion is folded along the fourth score line such that the second adhesive means on the fourth fold section is brought into engagement with the back side of the third fold section;

and wherein the rear cover panel is adapted to be secured to the front cover panel by bringing the third adhesive means on the fifth fold section into contact with a front side edge of the front cover panel to thereby complete the formation of a cover for binding a stack of loose sheets.

2. The cover according to claim 1, wherein the first, second and third adhesive means respectively include an adhesive strip covered by a release strip.

3. The cover according to claim 1, wherein the rear cover panel is rectangular shaped.

4. The cover according to claim 3, wherein the front cover panel is substantially the shape of the rear cover portion of the rear cover panel.

5. The cover according to claim 1, wherein the second fold section and third fold section are larger than the first fold section and the fourth fold section.

6. The cover according to claim 5, wherein the fifth fold section is the largest of the fold sections.

7. The cover according to claim 1, wherein the fifth fold section is the largest of the fold sections.

8. A method for binding a stack of loose sheets of paper into a booklet or brochure, wherein the stack of loose sheets of paper is bound within a two-piece cover including a front cover panel adapted to having printed or graphic material applied to at least one side thereof by way of a printing means and a rear cover panel, wherein said front cover panel is independent of the stack of loose sheets of paper; and wherein the rear cover panel includes a cover portion and a spine portion, the spine portion includes a front side, a back side and first, second, third, fourth and fifth score lines respectively defining first, second, third, fourth and fifth fold sections of the spine portion, and a first score line lies adjacent the cover portion and separates the cover portion from the spine portion, the method comprising the following steps:

folding the spine portion along the third score line to create a recess between the second fold section and the third fold section;

positioning the stack of loose sheets of paper within the recess;

securing the stack of loose sheets of paper within the recess;

folding the spine portion along the second score line and the fourth score line, and adhesively securing the back side o the first fold section to the back side of the second fold section at the back side of the fourth fold section to the back side of the third fold section to cover securing means used to secure the stack of loosed sheets of paper within the recess;

securing the fifth fold section to the front cover panel to thereby complete the formation of a cover for binding a stack of loose sheets of paper.

9. The method according to claim 8, wherein the step of securing the stack of loose sheets is accomplished by stapling the stack of loose sheets between the second fold section and the third fold section.

10. The method according to claim 9, wherein the front side of the fifth fold section includes adhesive means and the step of securing the fifth fold section to the front cover panel includes bringing the adhesive means on the fifth fold section into contact with a front side edge of the front cover panel to thereby complete formation of a cover for binding a stack of loose sheets of paper.

11. The method according to claim 10, wherein the adhesive means includes an adhesive strip covered by a release strip.

12. The method according to claim 9, wherein the back side of the first fold section includes adhesive means and the back side of the fourth fold section includes adhesive means, and the step of folding and adhesively securing includes folding spine portion along the second score line to bring the adhesive means on the first fold section into contact with the back side of the second fold section and folding the spine portion along the fourth score line to bring the adhesive means on the fourth fold section into contact with the back side of the third fold section.

13. The method according to claim 12, wherein the adhesive means includes an adhesive strip covered by a release strip.

14. The method according to claim 8, wherein the back side of the first fold section includes adhesive means and the back side of the fourth fold section includes adhesive means, and the step of folding and adhesively securing includes folding spine portion along the second score line to bring the adhesive means on the first fold section into contact with the back side of the second fold section and folding the spine portion along the fourth score line to bring the adhesive means on the fourth fold section into contact with the back side of the third fold section.

15. The method according to claim 14, wherein the adhesive means includes an adhesive strip covered by a release strip.

16. The method according to claim 14, wherein the front side of the fifth fold section includes adhesive means and the step of securing the fifth fold section to the front cover panel includes bringing the adhesive means on the fifth fold section into contact with a front side edge of the front cover panel to thereby complete the formation of a cover for binding a stack of loose sheets of paper.

17. The method according to claim 16, further including the steps of folding the spine portion along the first score line and folding the spine portion along the fifth score line to bring the front cover panel and the rear cover portion over the loose stack of sheets.

18. The method according to claim 8, wherein the front side of the fifth fold section includes adhesive means and the step of securing the fifth fold section to the front cover panel includes bringing the adhesive means on the fifth fold section into contact with a front side edge of the front cover panel to thereby complete the formation of a cover for binding a stack of loose sheets of paper.

19. The method according to claim 18, wherein the adhesive means includes an adhesive strip covered by a release strip.

20. The method according to claim 8, further including the steps of folding the spine portion along the first score line and folding the spine portion along the fifth score line to bring the front cover panel and the rear cover portion over the loose stack of sheets.

* * * * *